US008151453B2

(12) United States Patent
Garcia Tercero

(10) Patent No.: US 8,151,453 B2
(45) Date of Patent: Apr. 10, 2012

(54) CHANNEL-POSITIONING MACHINE

(76) Inventor: Lorenzo Garcia Tercero, Albacete (ES)

( * ) Notice: Subject to any disclaimer, the term of this patent is extended or adjusted under 35 U.S.C. 154(b) by 1145 days.

(21) Appl. No.: 11/993,293

(22) PCT Filed: Jun. 20, 2006

(86) PCT No.: PCT/ES2006/000363
§ 371 (c)(1),
(2), (4) Date: Dec. 20, 2007

(87) PCT Pub. No.: WO2006/136633
PCT Pub. Date: Dec. 28, 2006

(65) Prior Publication Data

US 2010/0158659 A1 Jun. 24, 2010

(30) Foreign Application Priority Data

Jun. 20, 2005 (ES) ..... 200501500
Jun. 19, 2006 (ES) ..... 200601653

(51) Int. Cl.
*B23P 21/00* (2006.01)

(52) U.S. Cl. ..... 29/781; 29/771; 29/779; 29/783; 29/786; 405/154.1; 405/174; 405/157; 414/497; 414/508; 414/553; 414/745.4; 414/745.5

(58) Field of Classification Search ..... 405/154.1, 405/157, 174; 29/781, 771, 773, 779, 783, 29/786, 791, 794; 414/497, 508, 553, 745.4, 414/745.5, 797.6, 542
See application file for complete search history.

(56) References Cited

U.S. PATENT DOCUMENTS

| | | | | |
|---|---|---|---|---|
| 4,043,135 | A * | 8/1977 | Hoes et al. | 405/174 |
| 4,498,807 | A * | 2/1985 | Kirkpatrick et al. | 405/43 |
| 5,145,282 | A * | 9/1992 | Payne | 405/155 |
| 5,304,015 | A * | 4/1994 | Sonomura | 405/232 |
| 6,830,412 | B2 * | 12/2004 | Perez | 405/180 |
| 7,314,344 | B2 * | 1/2008 | Chen et al. | 414/763 |

FOREIGN PATENT DOCUMENTS

| | | | |
|---|---|---|---|
| EP | 597539 | A1 * | 5/1994 |
| ES | 200001958 | | 9/2004 |
| FR | 2606431 | A1 * | 5/1988 |
| FR | 2646185 | A1 * | 10/1990 |

* cited by examiner

*Primary Examiner* — David Bryant
*Assistant Examiner* — Bayan Salone
(74) *Attorney, Agent, or Firm* — Collen IP; Donald J. Ranft

(57) ABSTRACT

The machine allows the placing of small troughs in trenches, made up by a loading platform (1) with a rotating conveyor (4) or sliding (7) for the small troughs (CA) to a feeding train (2) directing them towards an aligning box (3). The feeding train has folding sections (21), (22) and (23), being the central section (22) the one that has the coupling and linking means (24) to the tractor (T) and also where the loading platform (1) is journalled, the first section (21) is the one receiving the small troughs from the rotating conveyor (4), the second section (22) receives them from the sliding conveyor (7) and the third section (23) deposits the small troughs (CA) in the aligning box (2), which aligns the small troughs (CA) on which the corresponding covers (P) are overlapped by a device based on a framework (8) and an inclined platform (9).

9 Claims, 11 Drawing Sheets

CHANNEL-POSITIONING MACHINE

OBJECT OF THE INVENTION

Figure 1:
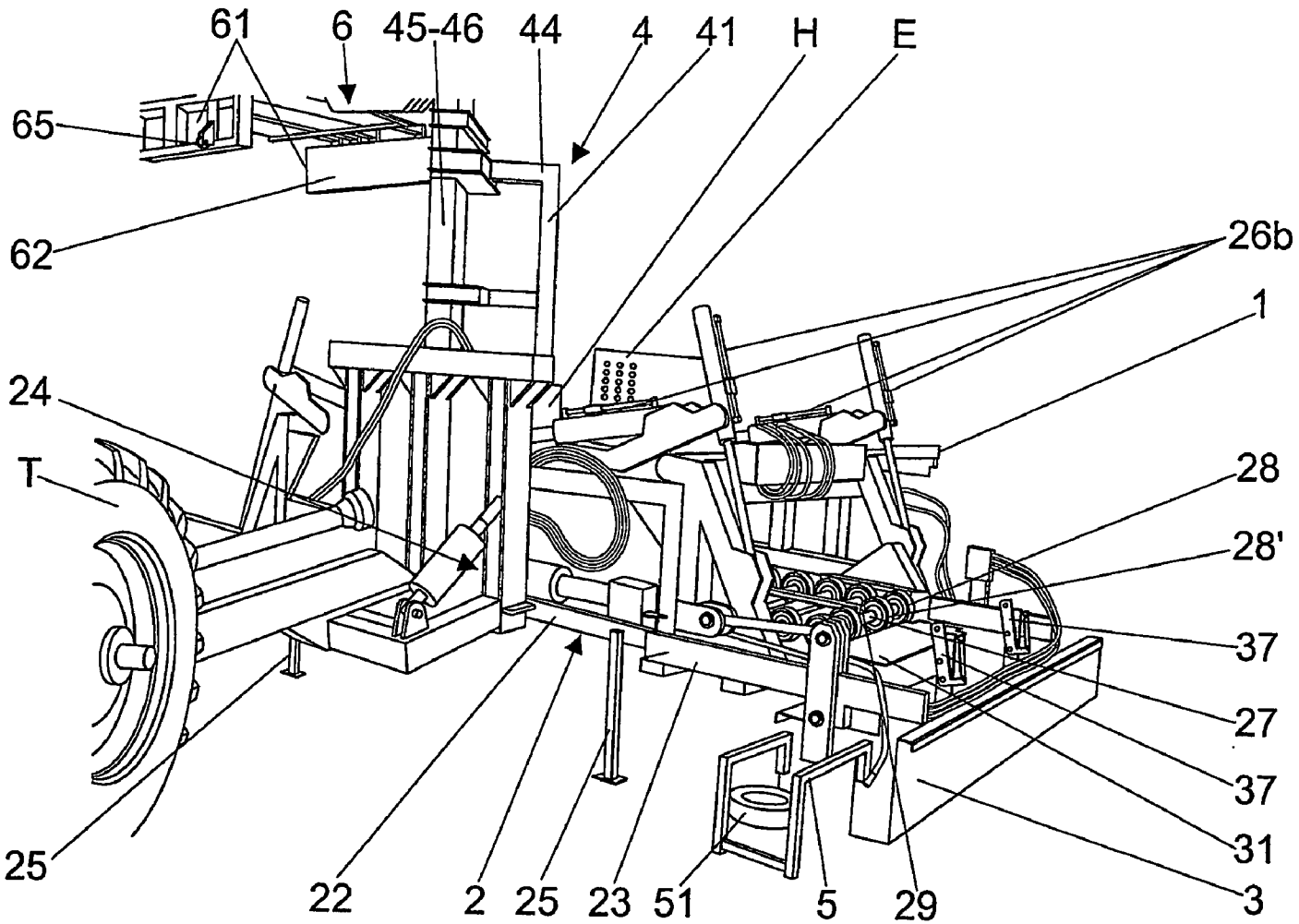

The present invention refers to a machine for laying small troughs, which offers novel essential characteristics with respect to the known similar means which are used in the present state of the art.

Generally, the invention has developed a machine for laying small troughs on trenches already carried out prefer ably in parallel with the railways, using prefabricated small troughs and comprising complementary means of dovetailing for its perfect alignment inside the trench.

In brief, the machine for laying small troughs is provided with some coupling means to a tractor and comprises a loading platform for small troughs, a rotating conveyor for small troughs from the loading platform to the feeding train, based on folding sections for its transport position and which feeding train is laying one by one and one after the other the small troughs within an aligning box capable of being introduced and driven by the corresponding trench, depositing in it the alignment of small troughs and their corresponding covers, these ones by means of a positioning device thereof, being all the elements connected and driven by hydraulic and electronic means, oriented and handled by means of the corresponding remote driving commands, from the site where the operator and tractor driver are located.

BACKGROUND OF THE INVENTION

At present, in order to carry out the laying of this type of small troughs, there are different types of machines, among them we find the ones which are combined with means to carry out altogether the trench and position and align in a simultaneous way the small troughs therein. This type of machines are described in the Spanish Patent 200001958, that regardless of the means to carry out the trench, they comprise a feeding train based on rollers, with two sections in angular position, one of them horizontally located where the small troughs are being deposited by hand, orienting them to the second inclined section for their laying and alignment within the trench. This type of machines has the drawback of their slow pace, since they should simultaneously carry out the digging of the trench itself and also deposit and align the small troughs, also requiring a great deal of hand labour for manipulating the small troughs up to their positioning in the horizontal section of the feeding train, besides the subsequent handling in order to avoid jammings and to allow the perfect arrival to the inclined feeding section.

Other type of machines to carry out the laying of these small troughs is formed by a feeding train also based on two sections, one of them slightly inclined from the trolley running on the rails of the railway, which carries the small troughs up to the second vertical section provided with a lift which deposits the small troughs in the box already included in the trench, which is carried out with an independent machine, making the alignment of the small trough by means of contacting with the previous small trough by some pushing means in the box and such push allows the forward movement of the whole set including the trolley over the railways. This type of machine is described in the Spanish Patent 9002548.

This type of machines have the drawback of requiring a great deal of labour force for the handling of small troughs up to their positioning in the slightly inclined section of the feeding train, in addition to the subsequent handling to avoid the jammings and to allow the perfect arrival to the box, additionally existing a great deal of breakages of small troughs as they suffer the pressure among themselves in order to carry out the advance of the machine.

DESCRIPTION OF THE INVENTION

The machine for laying small troughs object of the present invention comprises a loading platform, a sliding or rotating conveyor, a feeding train, an aligning box and a positioning device for the covers on the small troughs already aligned in the trench, which are perfectly coordinated and automated so that they are handled by only one operator from the tractor cabin and as a maximum by another operator who deposits the small trough pallets on the loading platform.

Another characteristic of the machine for laying small troughs object of the present invention consists of the folding disposition between its elements, which allows an easy and comfortable transport of the whole machine and on the corresponding transport gondolas.

Another one of the characteristics of the machine for laying small troughs object of the present invention consists of the rotating conveyor which allows the transport of a complete row of small troughs from the pallet already located on the loading platform, to the first section of the feeding train, the transport being carried out by a pressure jaw in which the small troughs are trapped forming each row of the pallet.

Another one of the characteristics of the machine for laying small troughs object of the present invention consists of the arrangement of a new type of conveyor by means of an endless band, which positions the small troughs at the edge of the central section of the feeding train, where they are positioned with the cooperation of the pressure jaw provided in the sliding pole and with lifting and lowering means for the pressure jaw, which is also horizontally rotating in relation with the above mentioned sliding pole.

Another one of the characteristics of the machine for laying small troughs object of the present invention, consists of the arrangement in two or three sections of the feeding train, the sections are foldable for their transportation and in their working position they are aligned in horizontal position, furthermore each section has rubber wheels on the ends of each axis, receiving the driving action by chain transmission, being the speed of each section different and in total relationship with the other two.

Another one of the characteristics of the machine for laying small troughs object of the present invention, consist of an aligning box, which receives the small troughs by a swiveling mean, from the third section of the feeding train and which aligning box is provided with the displacement means for the small troughs to their alignment and dovetailing with the previous one, also having an aligning box with automatic means to allow the perfect positioning on the trench and on the rest of the elements of the machine.

Another one of the characteristics of the machine for laying small troughs object of the present invention consists of a device for the positioning of the covers on the small troughs already laid on the trench and which are placed coupled to the aligning box.

BRIEF DESCRIPTION OF THE ACCOMPANYING DRAWINGS

The description of the object of the invention will be carried out based on the accompanying drawings, in which as a way of example and without any limiting character, therefore, it has been represented the preferred embodiment of the machine for laying small troughs object of the present invention.

In such above mentioned drawings the following features have been represented below:

FIG. 1 shows a perspective view of the machine for laying small troughs object of the present invention, in which it can be noted the aligning box, the feeding train from the third section and its linking elements to the tractor provided on the central section, the rotating conveyor with the pressure jaw in an intermediate position and subsequently the loading platform.

Figure 2:
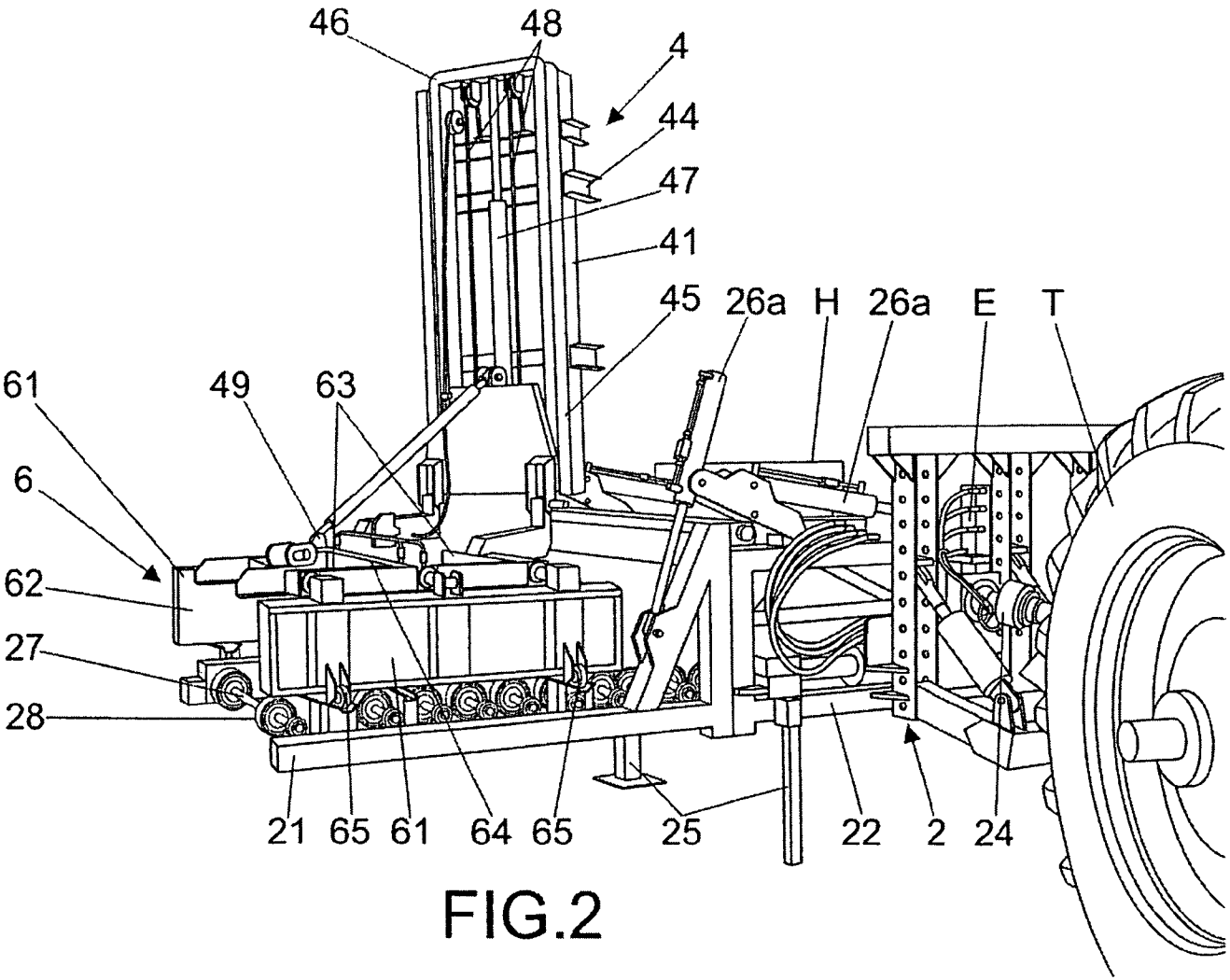

FIG. 2 comprises a perspective view of the machine for laying small troughs object of the present invention from the first section of the feeding train, from which the rotating conveyor can be seen with the pressure jaw in unloading position over the first section of the feeding train.

Figure 3:
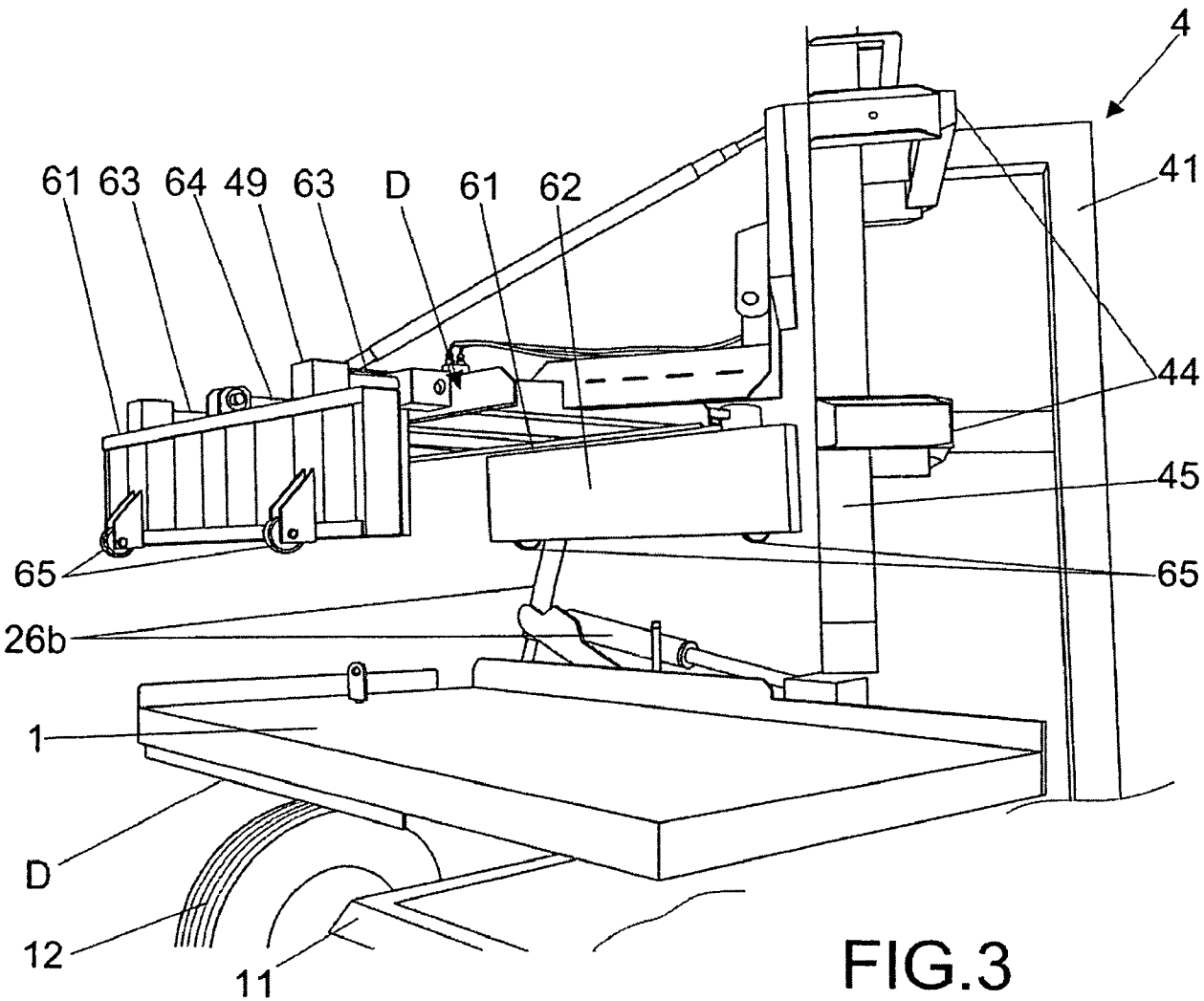

FIG. 3 comprises a perspective view of the machine for laying small troughs object of the present invention, in which it can be noted the loading platform and the rotating conveyor with the pressure loading jaw.

Figure 4:
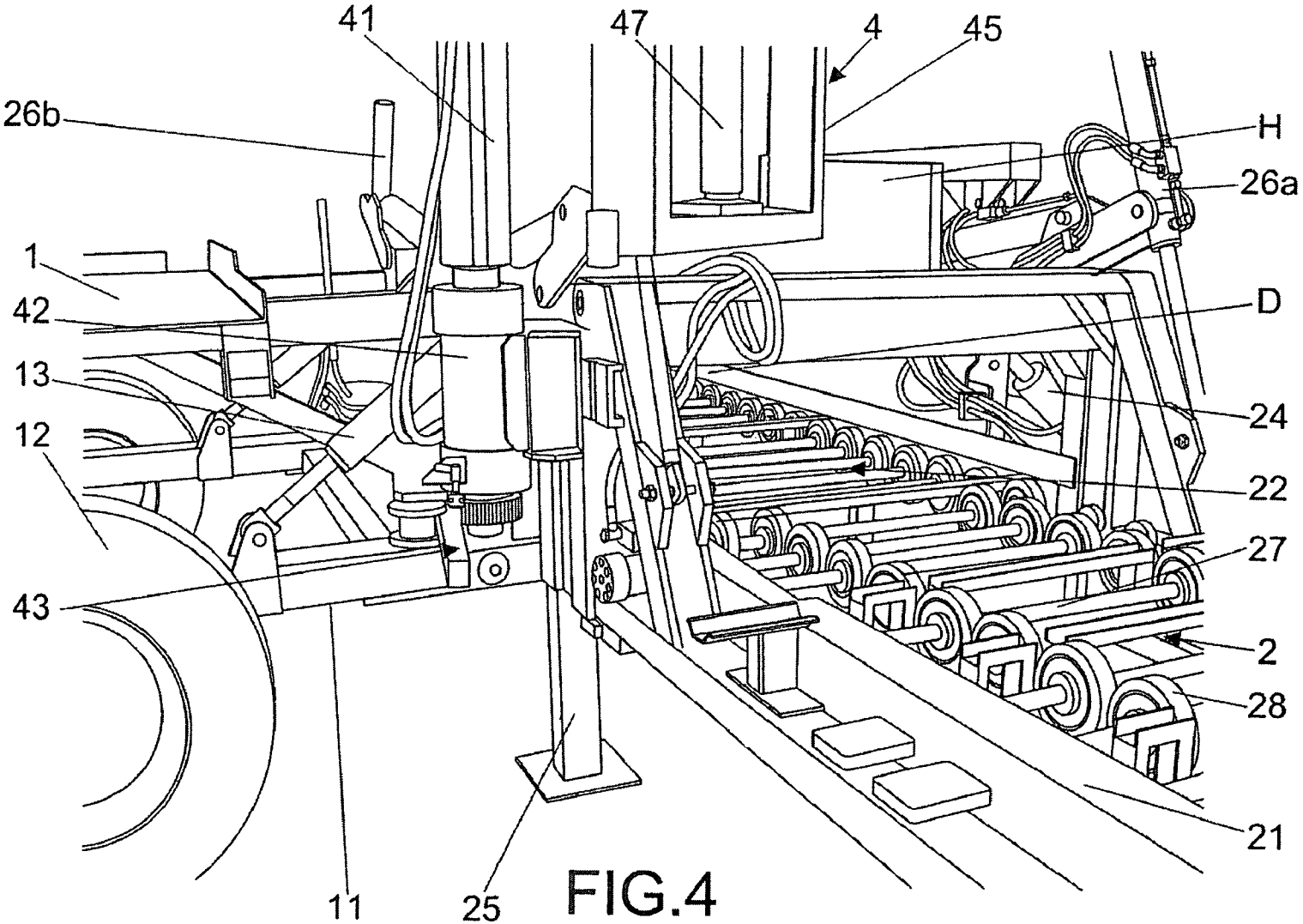

FIG. 4 shows a perspective view of the machine for laying small troughs object of the present invention where it can be noted the loading platform with the folding means on the central section of the feeding train and the lower area of the rotating conveyor.

Figure 5:
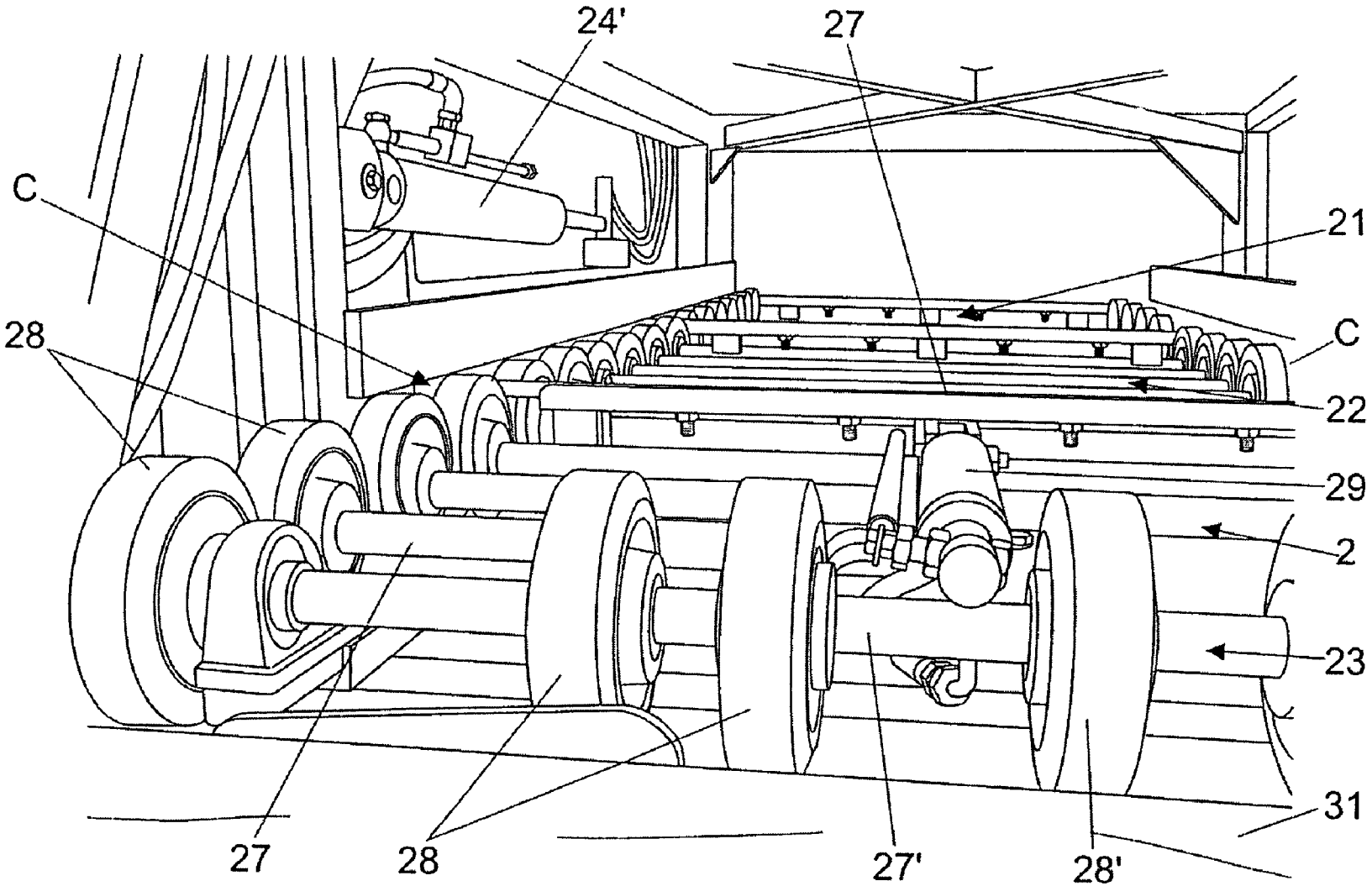

FIG. 5 consists of a perspective view of the machine for laying small troughs object of the present invention, in which it can be noted the third section of the feeding train and the swiveling means which directs the small troughs towards the aligning box.

Figure 6:
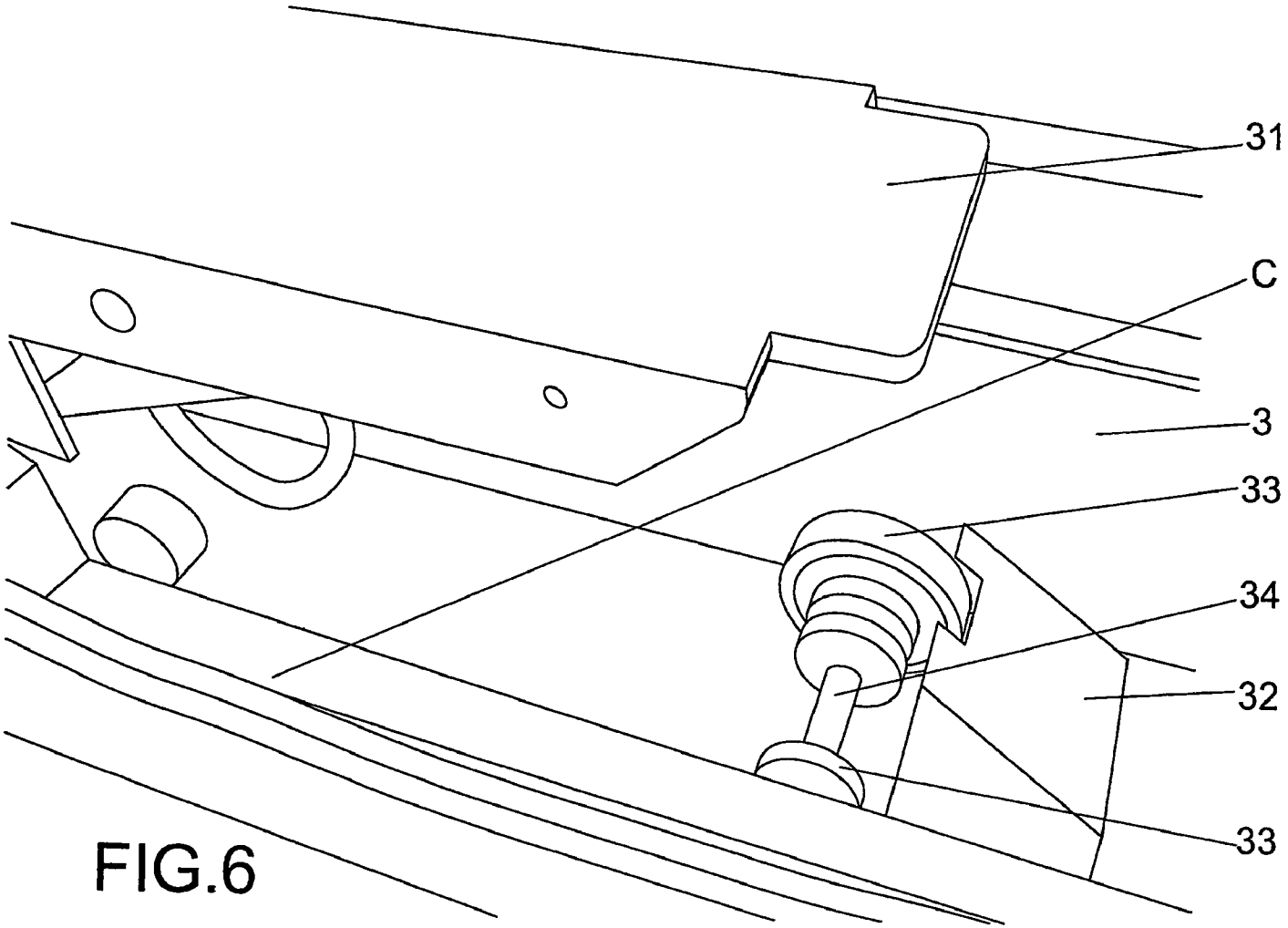

FIG. 6 consists of a perspective view of the machine for laying small troughs object of the present invention, where it can be noted the swiveling means which directs the troughs towards the aligning box, besides the lower inclined ramp and some pushing wheels for the small troughs.

Figure 7:
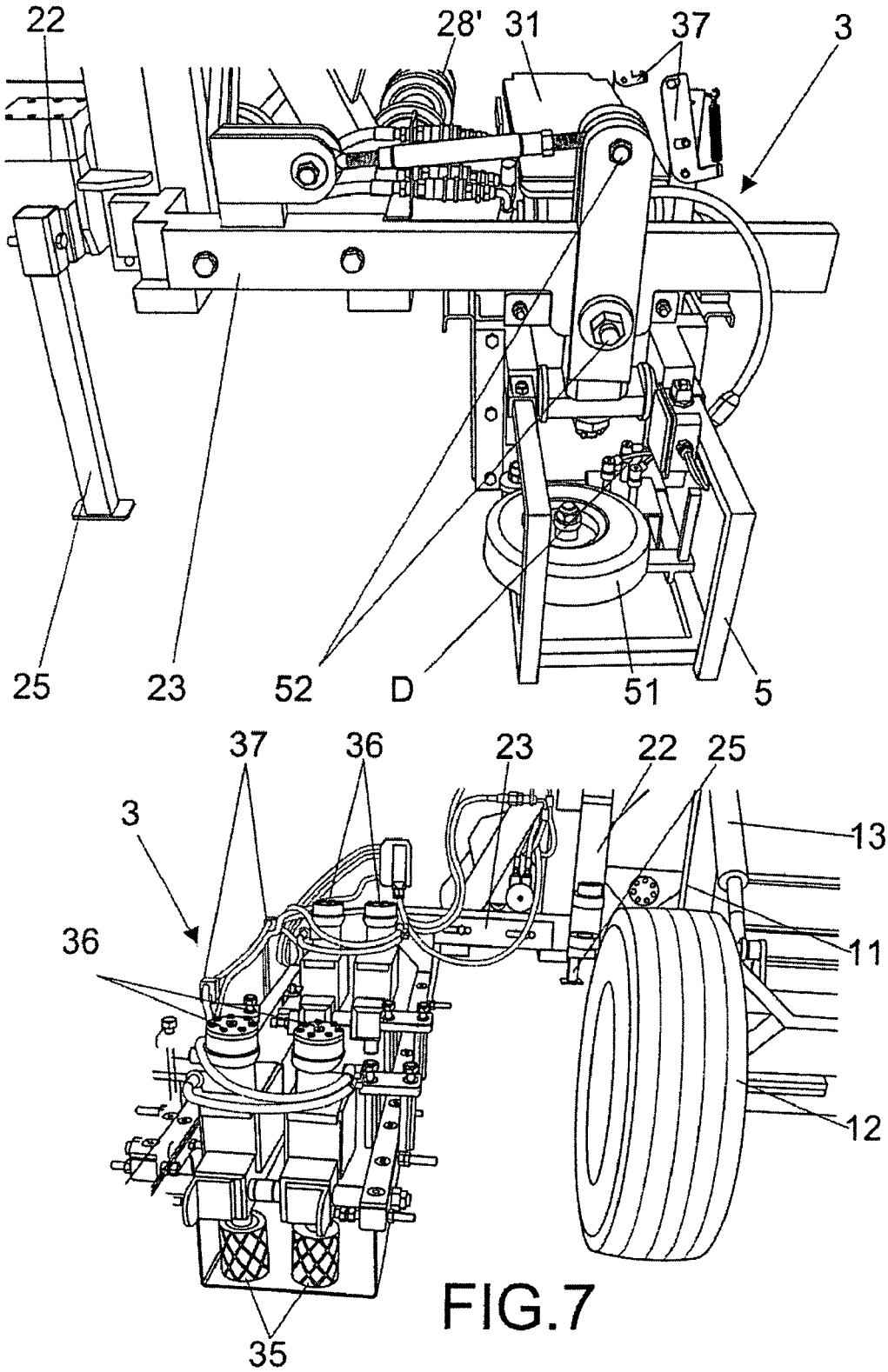
Figure 8:
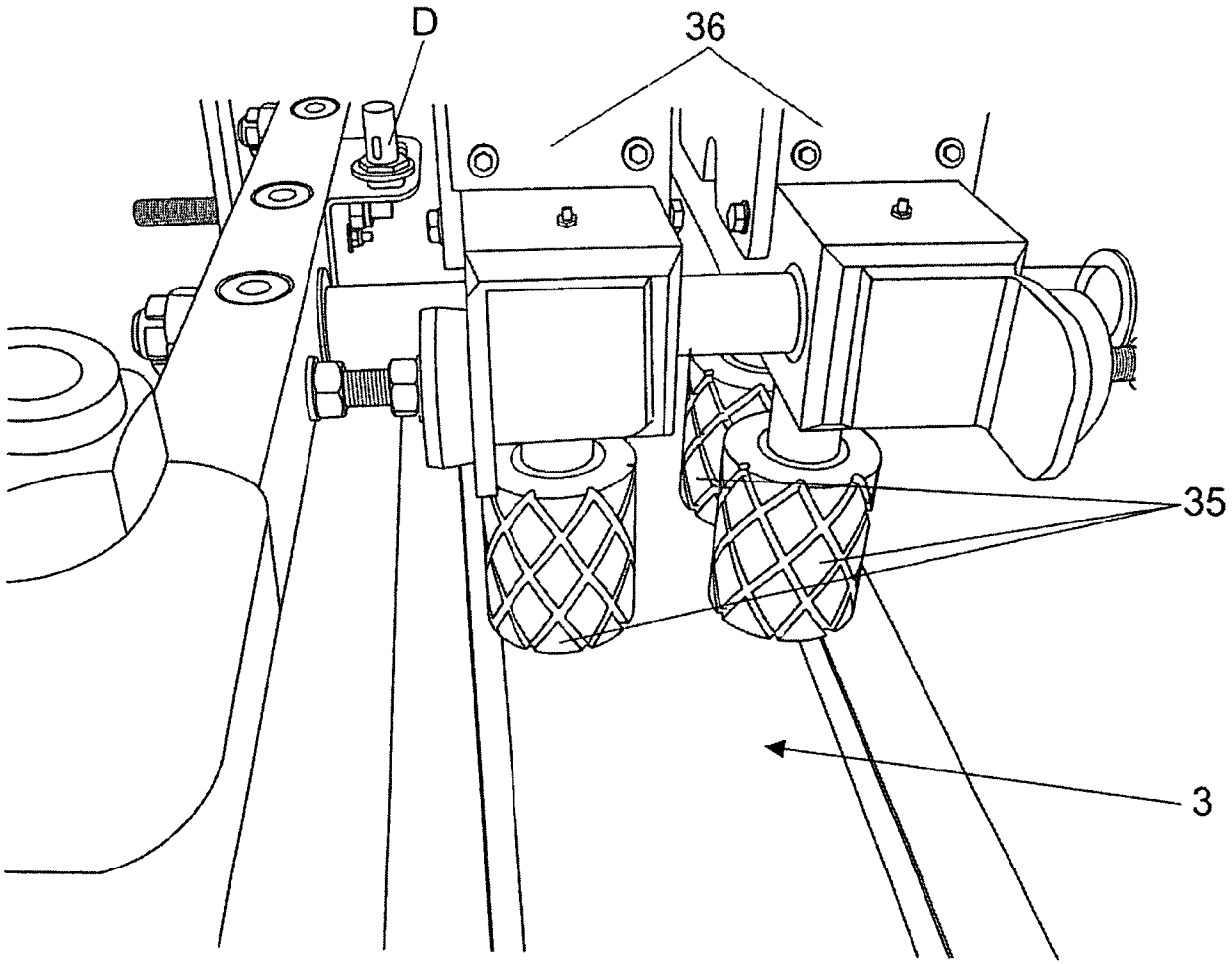

FIGS. 7 and 8 consist of both perspective views of the machine for laying small troughs object of the present invention, where the aligning box can be noted.

Figure 9:
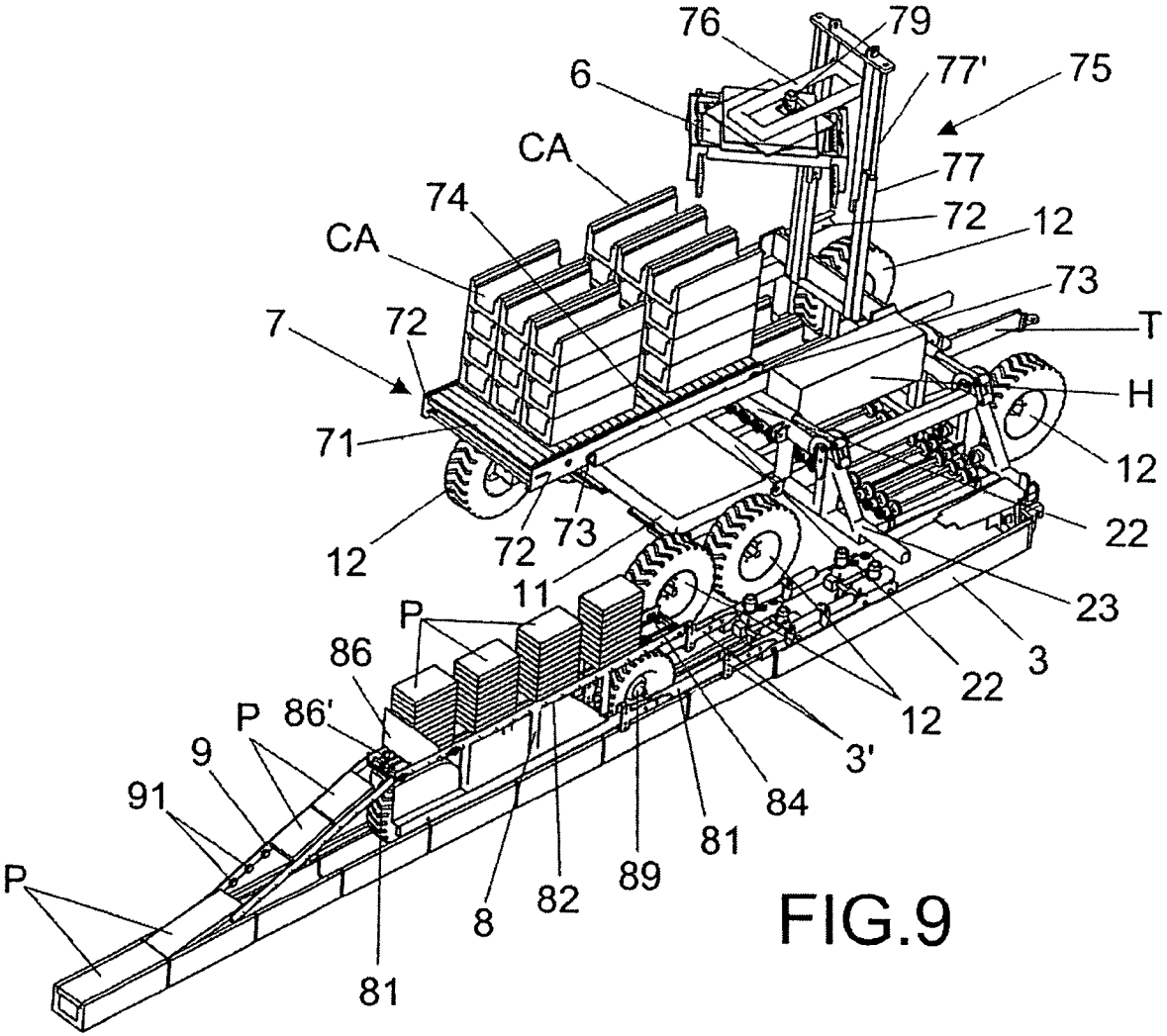

FIG. 9 shows a perspective view of the lateral side of the machine for laying small troughs object of the present invention, where the sliding conveyor device for the small troughs can be noted provided on the feeding train, with the endless band, the sliding pole and the pressure jaw, besides the positioning device for covers provided on the aligning box.

Figure 10:
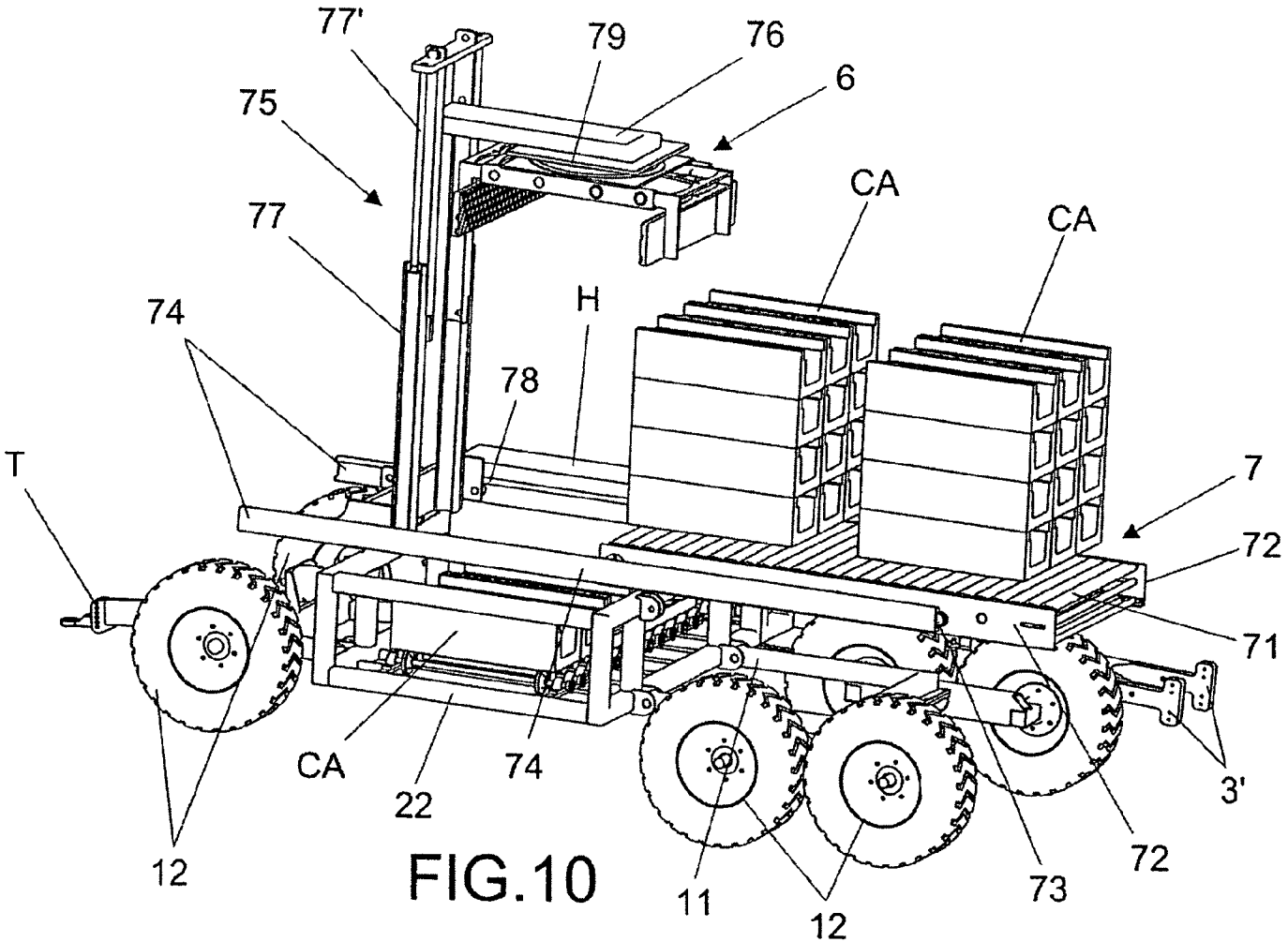

FIG. 10 comprises a perspective view of the other lateral side of the machine for laying small troughs object of the present invention, where a sliding conveyor device for the troughs can be noted provided on the feeding train with an endless band, the sliding pole and the pressure jaw.

Figure 11:
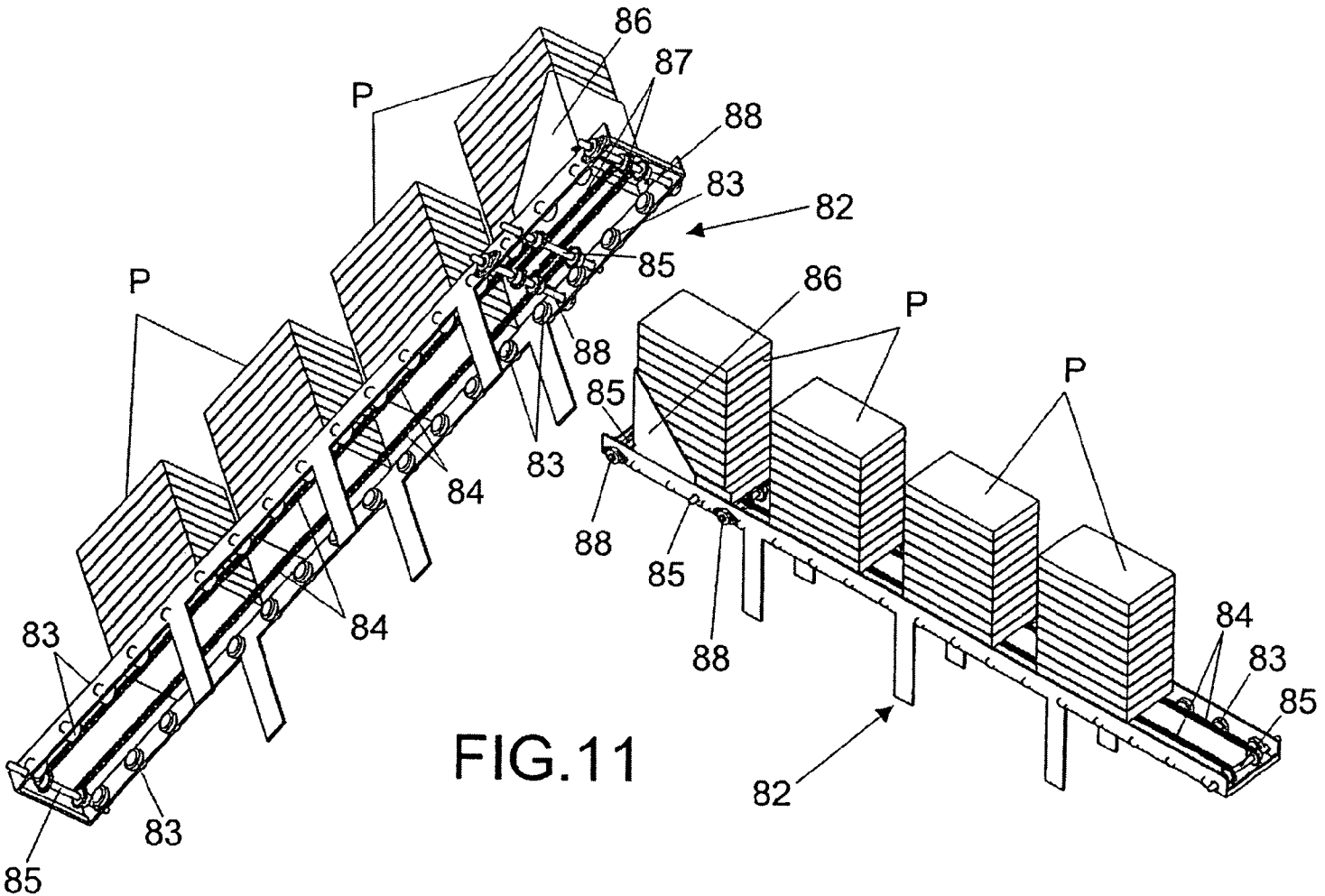

Lastly, FIG. 11 shows both perspective view of the framework on which are placed all the stacked covers of the positioning device thereof.

DETAILED DESCRIPTION OF THE PREFERRED EMBODIMENT OF THE INVENTION

The detailed description given bellow of the preferred embodiment of the invention is carried out based on the enclosed drawings, in which the corresponding parts or similar ones have been numbered with the same numerical references all along the represented figures.

As it can be noted in reference to the above mentioned drawings, the machine for laying small troughs object of the present invention is formed by a loading platform (1), a feeding train (2) and an aligning box (3) for the small troughs (CA), besides a rotating conveyor (4) for transporting the small troughs (CA) rows from the loading platform (1) to the feeding train (2).

The loading platform (1) is provided on a framework (11) with wheels (12) which is perpendicularly journalled to the feeding train (2) by means of hydraulic cylinders (13).

The feeding train (2) is made of by three framework sections, the first section (21), another central section (22) and another third section (23).

In the framework of the central section (22) it is journalled the framework (11) of the loading platform (1), while the opposite side of the above mentioned framework of the central section (22) is provided with the coupling and linking means (24) to the towing tractor T for towing and driving the whole set of the machine. The coupling means (24) are provided with a displacing and centering small cylinder (24').

The framework of the central section (22) of the feeding train is provided with legs (25) in the bottom of the base, while in the upper part it is provided with a central part (H) of the hydraulic means and with a central electronic part E for driving and automation of the driving elements of the machine.

To the central section (22) of the framework, the frameworks of the first section (21) and third section (23) of the feeding train (2) are journalled by the hydraulic means (26*a*) and (26*b*).

Each section (21), (22) and (23) of the feeding train (2) has a rolling mean for the small troughs, and a base for parallel axis (27) with wheels (28) of rubber profile. The axis (27) receives the driving action by means of a transmission by chains (C). The axis (27) of each section (21), (22) and (23) receives the driving action independently from one another, so that they can have different speed in each section (21), (22) and (23) of the axis (27) and wheels (28).

The last axis (27') of the third section (23) has other four central wheels (28') and on the rest of the axis of the above mentioned third section (23), a hydraulic cylinder (29) is located centrally and longitudinally.

The aligning box (3) is provided with a long section configuration shaped in "U" and it has in the upper part a swiveling platform (31), opposite to the outlet of the third section (23) of the feeding train (2).

Under the swiveling platform (31), the bottom of the aligning box (3) has a ramp (32) and two wheels (33) in the end of an axis (34) driven by a chain (C). In the central area and in the opposite end to the swiveling platform (31) are provided two towing means for the small troughs (CA), each one formed by two pairs of vertical rollers (35) driven by the upper means (36) and which are susceptible of being displaced towards the outer part until contacting with the internal areas of the small troughs (CA) walls. In the external wall of the aligning box (3) there are few stops (37) in opposite position to the hydraulic cylinder (29) of the third section (23) of the feeding train (2).

The aligning box (3) has in its other end, a framework (5) with a guiding wheel (51) in horizontal position over the trench and provided with three sensor elements (D) for positioning in relation to the three journalled members (52) of the framework (5) over the framework of the third section (23) of the feeding train (2).

The rotating conveyor (4) is formed by a rotating post (41) on a housing (42) in solidarity with the central section (22) of the feeding train (2) and next to the framework (11) of the loading platform (1). The post (41) has in the lower part rotating means (43) and has coupling upper sections (44) with two telescopic frames, a lower one (45) and another upper one (46) with regulation means between them based upon a hydraulic cylinder (47) and a chain pulley (48).

The upper frame (46) has some coupling means (49) with a pressure jaw (6) in horizontal position and forming a 45° angle in relation to the upper frame 46 and to the rest of the set of the rotating conveyor (4).

The pressure jaw (6) is formed by two rectangular and parallel plates (61), with internal nonslipping surfaces (62), linked by two lateral telescopic guides (63) and a central hydraulic cylinder (64), which allows the separation and/or approaching of the plates (61). Each plate (61) has in the lower part two pulley-wheels (65) susceptible of abutting on the supports (21') of the first framework (21).

In an embodiment alternative, the machine for laying small troughs object of the present invention has a conveyor (7) formed by an endless band (71) provided between two straps (72) and sliding by means of pulley-wheels (73) on two guide elements (74) parallel and arranged over the central section (22) of the feeding train (2), which can be done without its first section (21).

In the guide elements (74) it is also provided in a sliding way, a pole (75) provided with lifting and lowering means for the pressure jaw (6), which is mounted with rotating horizontal possibility in an orthogonal projection (76) of the pole (75).

The pole (75) is formed by pairs of telescopic sections, a lower pair (77) provided with the corresponding pulley-wheels (78) for sliding on the guide elements (72) and an upper pair (77') with the orthogonal projection (76) on which the pressure jaw (6) is coupled based on one half horizontal rotation (79).

The positioning device of the covers (P) of the small troughs (CA) is formed by a conveyor (8) based on wheels (81) to slide over the small troughs (CA) already installed, which is provided in the upper part with a horizontal framework (82) having in the interior of its lateral sides the opposite pulley-wheels (83), on which the stacked covers (P) slide and they are driven by two endless chains (84) provided between two axis (85) in the end of the framework (83).

In the upper part of the framework (83) and in its back end it has a stop (86) for the stacks of covers (P), having a lower window (86') for the passing of the lower covers (P) of the stack, which is pulled out for the driving of a second pair of endless chains (87) provided between the axis (88) located under the stop (86).

The framework (8) in its front ends is coupled to the aligning box (3), by means of a pair of sections (89) linked to the pair of projections (3') of the aligning box (3).

The framework (8) has in its back end, the coupling of an inclined platform (9), which lower end slides by the edges of the small troughs (CA) already installed in the trench and it is formed by means of a frame with pulley-wheels (91) in the inside of its larger sections, on which the covers slide until being deposited on the edges of the small troughs (CA) already installed in the trench.

All the mechanism of the machine structure are driven by hydraulic or electronic centralized means located in the elements (H and E), placed on the upper part of the framework (22) of the central section of the feeding train (2).

Based on this structure, the operation of the machine for laying small troughs (CA) object of the present invention, consists of providing the pallets with the small troughs (CA) on the loading platform (1) and with the conveyor (4) rotated towards the above mentioned loading platform (1), in such a way that the plates (61) of the jaw (6) in their opened position, remain on each side of the upper row of the small troughs (CA) on the pallet.

By driving the jaw (6) the plates (61) come closer, being trapped the upper row of small troughs (CA), so that by means of turning the rotating conveyor (4), the jaw (6) will be set on the first section (21) of the feeding train and by lowering the jaw by means of driving the frames (45) and (46), the jaw (6) will remain with the pulley wheels (65) abutting on the supports (21'). On this situation when the separation of the plates (61) is produced, the small troughs (CA) are on the wheels (28) of the first section (21) of the feeding train (2).

In this situation the small troughs (CA) pass from the first section (21) to the central section (22) and from the latter one to the third section (23), all that in different speed in order to adapt the running at the necessary rate for a good supply from the third section (23) to the swiveling platform (31) pushed by the hydraulic cylinder (29) of the third section (23), to the stops (37) of the aligning box (3).

In the other alternative embodiment based on the sliding conveyor (7), the stacks of small troughs (CA) whether or not provided by their pallets, are deposited on the back part of the endless band (71), being transported up to the other end, where the pressure jaw (6) takes up the upper raw which is deposited in the central section (22) of the feeding train (2), by means of the driving action produced by the lifting and lowering pole (75) of the pressure jaw (6).

The rotation means (79) of the pressure jaw (6), are driven turning 90° to the above mentioned pressure jaw (6) so that the stacks of the small troughs (CA) are deposited on the endless band (71) in transversal position in relation to the feeding train (2).

Similarly, when the stacks of the small troughs (CA) are deposited on the endless band (71) provided in the corresponding lower part of the pallet, on the straps (72) of the endless band (71), a device is provided in order to expel the pallet, based on a conventional system not shown in the enclosed drawings.

The small troughs (CA) are transported by the central sections (22) and the third section (23) of the feeding train (2), until its positioning in the aligning box (3).

In this situation, the weight of the small trough (CA) makes the swiveling of the platform (31), falling the small trough on the wheels (33) and displacing it in order to slide on the ramp (32) until it is taken by the first two pairs of vertical rollers (35), transporting it up to the second two pairs of vertical rollers (35), which are the ones depositing the small trough (CA) in the corresponding trench.

The following small troughs (CA) make the same traveling and when they reach the two second pairs of vertical rollers besides being deposited in the trench, they also remain dovetailed with the previous one.

The wheel (51) in its traveling on the trench and their corresponding sensors (D), are the ones which establish the relative positioning between the feeding box and the rest of the machine.

The positioning of the covers (P) on the mouth of the small troughs (CA) already laid on the trench, is carried out at the same time with the positioning of the small troughs (CA), by means of the conveyor (8), in the following way.

The covers (P) stacks are provided on the horizontal framework (82), with the lateral edges of the lower ones provided on the pulley-wheels (83) by which they slide pushed by the endless chains (84) up to the stop (86) where the first stack of covers (P) is retained and all the stacks stopped.

In this position, the lower cover (P) of the first stack of covers (P) is pushed by the endless chains (87) and is expelled to the outside by the window (86') up to the inclined platform (9), where sliding by gravity over the trolley-wheels (91), remain subsequently located one by one and in a continuous way over the small troughs (CA) already installed in the trench.

When the covers (P) of the first row are finished, the endless chains (84) start running again automatically in order to carry the following stack up to the stop (86) and initiating again the outlets of the lower covers P.

The operator who drives the tractor is the same person that operates from the cabin the loading platform (1) to the second two pairs of rollers (35) of the aligning box (3) and to the placing of the covers (P) on the small troughs (CA) already installed in the trench.

All the hydraulic and electronic mechanism of the machine are automated and there are security and presence sensors D which do not allow the functioning of one of the parts, if anyone of the others parts has an abnormal functioning.

The machine for laying small troughs object of the present invention, when it is not in operative condition is able to reduce its volume for the transportation, due to the folding joints between its parts, specifically:

between the framework (11) of the loading platform (1) and the framework (22) of the central section of the feeding train (2) based on the hydraulic cylinders (13), and between the first section (21) and the third section (23) of the feeding train (2), based on the hydraulic cylinders (26*a*) and (26*b*), with the use of the conveyor (7), since the first section (21) can be eliminated from the feeding train (2), besides being able to fold the endless band (71) which covers the central section (22) of the feeding train, and as a result, the volume of the machine is considerably reduced.

Another advantage consists of the automatic arrangement of the covers P, which supposes the reduction of the installation cost, since they do not have to be manually installed.

The invention claimed is:

1. CHANNEL-POSITIONING MACHINE, being the type used in the placing and alignment of the prefabricated and dovetailed small troughs and which are provided with a loading platform (1), a feeding train (2) and an aligning box (3) for the small troughs (CA) with an enlarged section configuration in "U" shape and the ones also having coupling and linking means (24) to the tractor "T", being essentially characterized, in that:

the loading platform (1) has a framework (11) with wheels (12), which is perpendicularly journalled to the feeding train (2) by means of hydraulic cylinders (13);

the feeding train (2) is formed by three sections of foldable frameworks among them, a first section (21), another central section (22) and a third section (23), having rolling means for the small troughs, based on parallel axis (27) with wheels (28) with rubber profile, receiving the axis (27) the driving action by means of a transmission by chains (C) and the axis (27) of each section (21), (22) and (23) receive independently the driving action from one another, in order to have different speed in each section (21), (22) and (23) of the axis (27) and wheels (28);

the aligning box (3) which has a long configuration with section in "U" shape, and has in the upper part a swiveling platform (31), opposite to the outlet of the third section (23) of the feeding train (2), under such swiveling platform (31), the bottom of the aligning box (3) has a ramp (32) and two wheels (33) in the end of an axis (34) driven by a chain (C) while in the central area and in the opposite end of the swiveling platform (31), two towing means are provided for the small troughs, which are formed each one of them by two pairs of vertical rollers (35) driven by the upper means (36) and which are susceptible of being displaced towards the outer part until contacting with the internal areas of the small troughs walls, also having the aligning box (3) in its external wall few stops (37) in opposition to the hydraulic cylinder (29) of the third section (23) of the feeding train (2), while in its front end it is provided with the framework (5) with the guiding means on a trench;

the rotating conveyor (4) is formed by a rotating post (41) on a housing (42) in solidarity with the central section (22) of the feeding train (2) and next to the framework (11) of the loading platform (1) which post (41) has in a lower part rotating means (43) and exhibits in an upper part coupling sections (44) with two telescopic frames, a lower one (45) and another upper one (46) with regulation means between them based on a hydraulic cylinder (47) and a chain pulley (48), also having an upper frame (46) of some coupling means (49) with a pressure jaw (6) in horizontal position and forming a 45° angle in relation to the upper frame (46) and the rest of the set of the rotating conveyor 4;

further characterized in that it comprises:

a conveyor (7) for the supply of small troughs (CA) rows up to the feeding train (2);

a positioning device of the covers (P) on the small troughs (CA) already installed on the trench, based on one inclined platform (9) and a framework (8) coupled to the aligning box (3).

2. CHANNEL-POSITIONING MACHINE according to claim 1, characterized in that the framework of the central section (22) of the feeding train is provided with legs (25) in the bottom of the base, while in its back area it is journalled the framework (11) of the loading platform (1) and in the opposite side of the above mentioned framework of the central section (22), it is provided with a coupling and linking means (24) to the tractor (T) for towing and driving the whole set of the machine and which coupling means (24) have displacing and centering small cylinder (24'), being also journalled to a lateral side of the framework of the central section (22), by hydraulic means (26*a*) and (26*b*), the frameworks of the first section (21) and the third section (23) of the feeding train (2).

3. CHANNEL-POSITIONING MACHINE, according to claim 1, characterized in that a last axis (27') of the third section (23) of the feeding train (2) has four central wheels (28') and on the rest of the axis of the above mentioned third section (23), the hydraulic cylinder (29) located centrally and longitudinally, opposite to the stops (37) of the aligning box (3).

4. CHANNEL-POSITIONING MACHINE, according to claim 1, characterized in that, the pressure jaw (6) is formed by two rectangular and parallel plates (61), with internal non-slipping surfaces (62) linked by two lateral telescopic guides (63) and a hydraulic central cylinder (64), which allows the separation and/or the approach between the plates (61), having each plate (61) in a lower part two pulley-wheels (65) susceptible of abutting on supports (21') of the first framework (21).

5. CHANNEL-POSITIONING MACHINE according to claim 1, characterized in that, a framework (5) has one horizontal guiding wheel (51) on the trench and provided with three positioning sensors (D) in relation with three joints (52) of the framework (5) on the frame-work of the third section (23) of the feeding train (2).

6. CHANNEL-POSITIONING MACHINE according to claim 1, characterized in that the conveyor (7) for the supply of rows of small troughs (CA) to the feeding train (2) is formed by an endless band (71) provided between two straps (72) and sliding by trolley-wheels (73) over two parallel guide elements (74) and provided on the central section (22)

of the feeding train (2), in which guide elements (74) is also provided in a sliding way, a pole (75) provided by lifting and lowering means for the pressure jaw (6), which is mounted with possibility of horizontal rotation in an orthogonal projection (76) of the pole (75).

7. CHANNEL-POSITIONING MACHINE according to claim 1, characterized in that the conveyor 8 of the positioning device for the covers (P) of the small troughs (CA) is by its front end coupled to the aligning box (3), by means of a pair of section (89) linked to a pair of projections (3') of the aligning box (3) and it is formed based on wheels (81) to slide on the small troughs (CA) already installed, which have in an upper part of a horizontal framework (82) provided in the inside of its lateral sides opposite trolley-wheels (83), on which the covers (P) slide stacked and moved by two chains (84) provided between two axis (85) in the end of the framework (83), which in its upper part and its back end has a stop (86) for the stacks of covers (P), having a lower window (86') for the passage of the lower cover (P) of the stack, which is pulled out by the driving of a second pair of endless chains (87) provided between an axis (88) located under the stop (86).

8. CHANNEL-POSITIONING MACHINE according to claim 1, characterized in that the inclined platform (9), which is coupled to the back end of the conveyor (8) and its lower end slides on the edges of the small troughs (CA) already installed in the trench, is formed by a frame with trolley-wheels (91) in the inside of its larger sections, for this reason the covers (P) slide until being deposited on the edges of the small troughs (CA) already installed in the trench.

9. CHANNEL-POSITIONING MACHINE according to claim 1, characterized in that the pole (75) is formed by pairs of telescopic sections, a lower pair (77) provided with the corresponding trolley-wheels (78) for sliding on the guide elements (72) and an upper pair (77') with the orthogonal projection (76) in which the pressure jaw (6) is coupled based on a horizontal rotation means (79).

* * * * *